United States Patent [19]

Birkhofer

[11] 4,376,504

[45] Mar. 15, 1983

[54] MACHINE FOR ATTACHING BUTTONS HAVING SHANKS TO AN ARTICLE IN A CORRECTLY BUTTONED CONDITION

[75] Inventor: Herbert Birkhofer, Brunswick, Fed. Rep. of Germany

[73] Assignee: Firma Schaeffer-Homberg GmbH, Wuppertal, Fed. Rep. of Germany

[21] Appl. No.: 189,557

[22] Filed: Sep. 22, 1980

[30] Foreign Application Priority Data

Sep. 28, 1979 [DE] Fed. Rep. of Germany ..... 2939262

[51] Int. Cl.[3] ..... A41H 37/10

[52] U.S. Cl. ..... 227/32; 227/35; 227/153

[58] Field of Search ..... 227/12, 13, 30, 31, 227/32, 34, 35, 141, 149, 153, 25, 65

[56] References Cited

U.S. PATENT DOCUMENTS

| | | | |
|---|---|---|---|
| 1,967,662 | 7/1934 | Clark | 227/32 |
| 3,695,086 | 10/1972 | Savage | 227/149 X |
| 4,065,045 | 12/1977 | Pray | 227/149 X |
| 4,247,032 | 1/1981 | Stanik | 227/32 X |

FOREIGN PATENT DOCUMENTS

| | | | |
|---|---|---|---|
| 2731079 | 1/1979 | Fed. Rep. of Germany | 227/34 |

*Primary Examiner*—Howard N. Goldberg
*Assistant Examiner*—Fred A. Silverberg
*Attorney, Agent, or Firm*—Martin A. Farber

[57] ABSTRACT

A machine for the attachment of buttons provided with shanks to articles provided with buttonholes, having a lower tool which holds a button upper part and moves relative to the lower tool towards the latter. A device is disposed in front of the upper tool for widening the buttonhole to approximately the clear width of the shank to be seated through the buttonhole onto the underlying layer of material.

13 Claims, 9 Drawing Figures

MACHINE FOR ATTACHING BUTTONS HAVING SHANKS TO AN ARTICLE IN A CORRECTLY BUTTONED CONDITION

The present invention relates to a machine for attaching buttons having shanks or the like to articles of clothing or the like provided with buttonholes, which machine has a lower tool supporting the lower part of the button and an upper tool which holds the upper part of the button and moves relative to the lower tool towards the latter.

It is known, for instance, in the case of jeans and slacks to provide buttons at one end of the waistband. After the buttoning of the overlapping ends of the waistband it is frequently found, however, that a proper positioning of the overlapping ends of the waistband has not been obtained. Pulling wrinkles then occur which are found disagreeable and lead to complaints. Since after the attachment of the buttons the buttoning is always effected by the manufacturer himself, this results in a cost-increasing production of the clothing.

The object of the present invention is to develop a machine of the type in question which is of simple construction in such a manner that, on the one hand, mispositioning of the button is definitely avoided while on the other hand a streamlining of the production of the garments is obtained.

In accordance with the present invention a device is disposed in front of the upper tool for widening the buttonhole to approximately the clear width of the shank to be seated through the buttonhole onto the underlying layer of material.

As a result of this development, a machine of the above-indicated type which is of increased value in use is created. It is now possible to fasten buttons which are provided with shanks or the like through the buttonhole onto the underlying layer of fabric. In this way, for instance, there is obtained a correct positioning of the overlapping ends of the waistbands of jeans and slacks. Complaints as to improperly attached buttons are thereby eliminated. Furthermore, the subsequent buttoning after attachment is eliminated, resulting in a streamlining of the production of the garment. Before the shank of the button is passed through the buttonhole, the device which is associated with the upper tool already effects a widening of the buttonhole so that the shank can then be passed through it without constraining or damaging the edge of the buttonhole. In the case of buttons which are to be applied to pants this means that the ends of the waistband are placed one over the other in such a manner by the operator of the machine that the buttonhole lies in the path of movement of the shank of the button. Accurate application can, in this connection be favored, for instance, by markings or by a suitable target device. It is possible to obtain the widening of the buttonhole in various manners. One advantageous embodiment consists in opening the buttonhole by arching it. For this it is merely necessary to arrange a small foot which is displaceable against spring action in front of the upper tool. Upon the downward movement the foot surfaces of the foot place themselves on both sides of the button rivet, onto the upper layer of material and move the supporting surface of the lower tool downward, the rivet of the lower button part remaining stationary and producing the arching, which permits the subsequent passage of the shank of the button. On the other hand, the widening of the buttonhole can also be produced by projections associated with the gripper jaws. Upon the downward movement of the upper tool these projections first of all place themselves on the upper layer of material on both sides of the buttonhole. Upon the following spreading apart of the gripper jaws and the resultant release of the upper part of the button, they carry the edges of the buttonhole along with them by friction or in positive (form-locked) fashion and thereby bring about a widening of the buttonhole. Since said spreading movement is derived from inclined surfaces on the upper-tool ram, the construction can be kept very simple. Furthermore, subsequent retooling of the machine is possible without any great structural expense, as is also true of the first embodiment. Furthermore, a widening of the buttonhole by positive (form-locked) engagement into a buttonhole is possible. This result is obtained by one of the projections engaging into the buttonhole upon the downward travel of the upper tool and effecting the opening of the buttonhole upon the spreading apart of the gripper jaws which then takes place. Combined frictional and positive (form-locked) opening of the buttonhole is also possible. In such case, the finger which is seated on the one gripper jaw engages into the buttonhole while the other projection places itself with frictional engagement via its friction covering on the upper layer of material.

Three illustrative embodiments of the invention will be described below with reference to FIGS. 1 to 9, in which.

Figure 1:
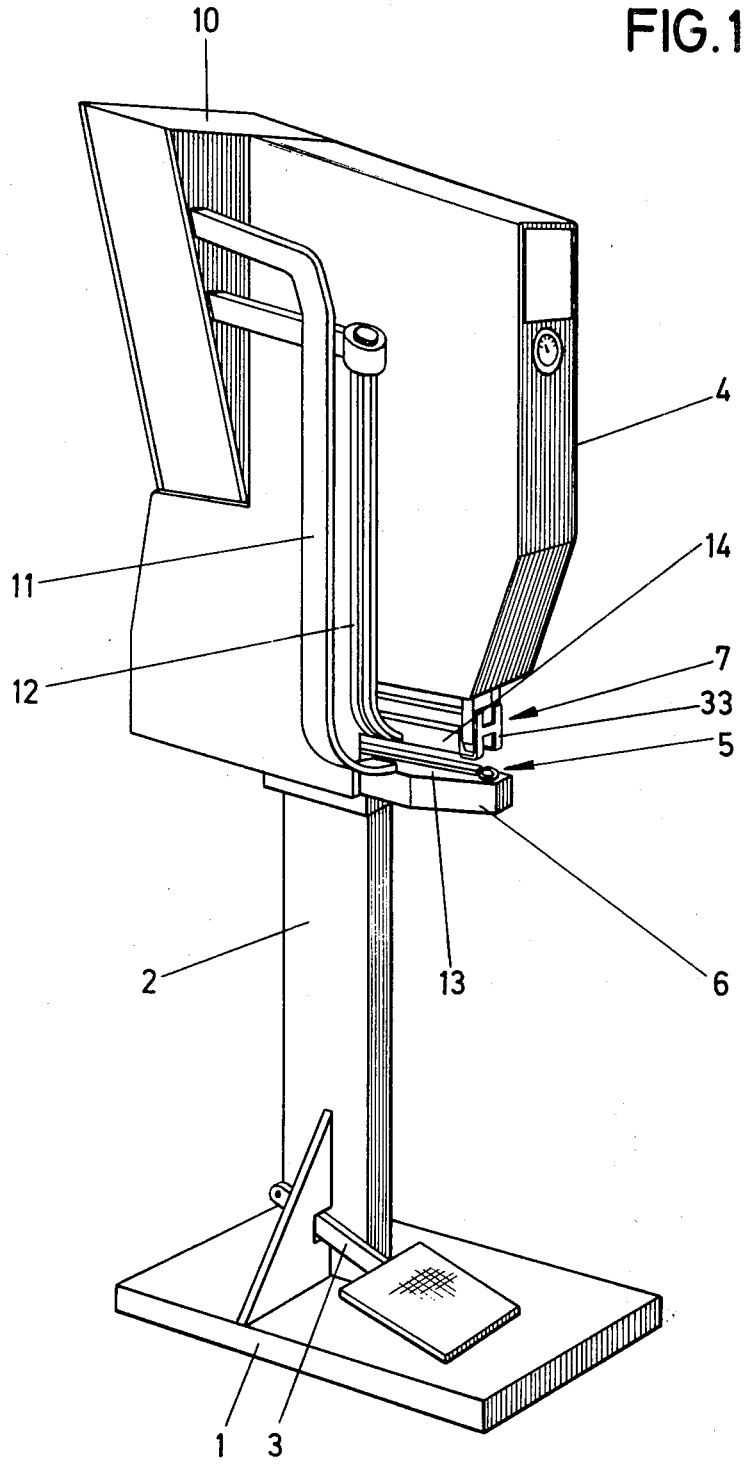
FIG. 1 shows in perspective a machine for the attachment of buttons in accordance with the first embodiment.

The machine shown in FIG. 1 has a machine column 2 which is carried by a base plate 1. At the lower region of the column there is supported thereon a pedal 3 which, by means of a lever system not shown, starts the operating stroke of the machine.

The column 2 carries the machine housing 4 which on its bottom has an extension 6 which contains the lower tool 5.

The upper tool 7 extends above and in line with the lower tool 5 and can be moved towards the lower tool 5 by a reciprocation device which is not shown.

The lower parts 8 and upper parts 9 of the button come from a magazine 10 via feed rails 11, 12 to workpiece feed slides 13, 14 which place the button parts 8, 9 in synchronism, into the lower tool 5 and the upper tool 7 respectively.

Figure 5:
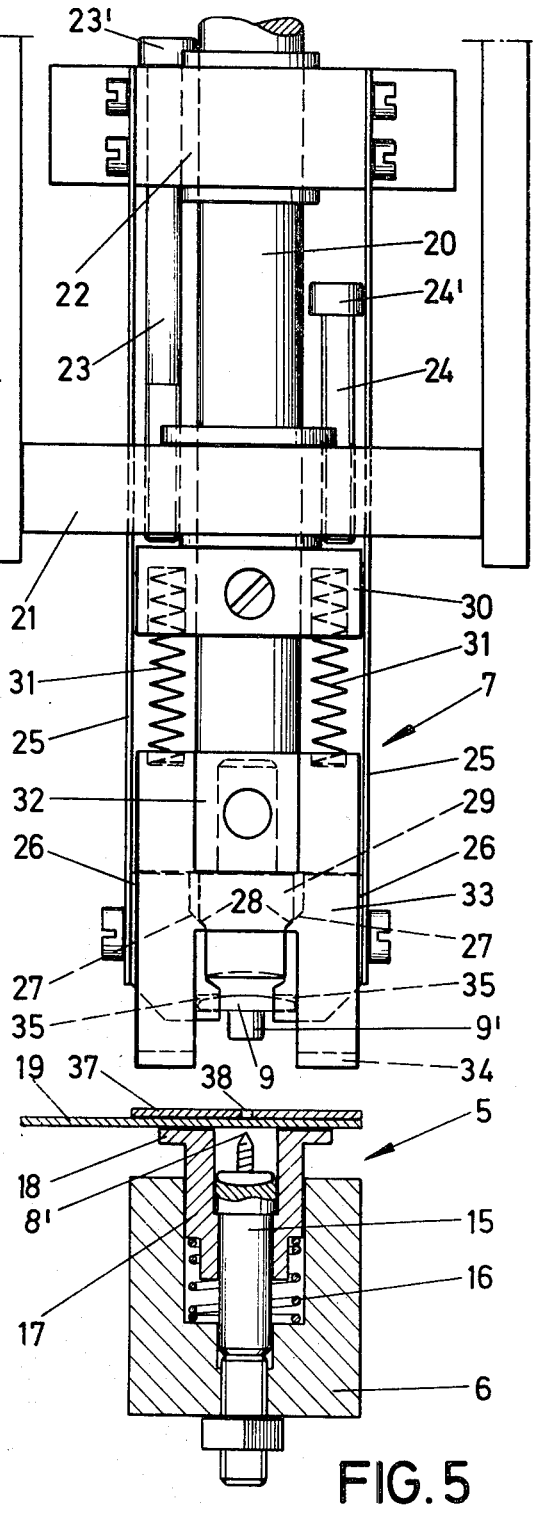
FIG. 5 is a side view of FIG. 4, but with the lower tool shown in section with the layers of material applied.

The lower tool 5 has, in particular, an adjustable ram 15 whose upper end receives the button lower part 8; see FIG. 5. This ram 15 guides a bushing 17 which is under the action of a compression spring 16 and the rim 18 of which, extending above the extension 6, forms the supporting surface for the lower piece 19 of the material. From FIG. 5 it can be seen that the tip 8' of the button rivet 8 lies below the supporting surface (rim 18).

The upper tool 7 which is located above and in line with the lower tool 5 has a downwardly traveling push rod 20. The lower end of the latter is guided in a bearing bracket 21 of the machine housing 4. Above the bearing bracket 21 the push rod 20 carries a slide 22 which is displaceable relative to the push rod 20. The slide is biased in an upward direction by a tension spring, not shown. The slide 22 is provided with a limit stop in the upward direction by the head 23' of a screw 23 which extends from the bearing bracket 21. The bearing bracket 21 furthermore carries a screw 24 whose head 24' limits the downward displacement of the slide 22.

On both sides of the slide 22 there are arranged spring blades 25 which extend in a downward direction and carry at their ends gripper jaws 26. The gripper jaws 26 are provided with oblique surfaces 27 on their facing inner flanks. Upon the downward displacement of the push rod 20, oblique flanks 28 of the upper tool ram 29 associated with the push rod 20 come against the oblique surfaces 27.

Below the bearing bracket 21 there is seated in non-displaceable manner on the push rod 20 a support bearing 30 which receives one end of the compression springs 31 which extend on both sides of the push rod. The other ends of these compression springs 31 act on a connecting link 32 which is slideable on the push rod 20. This link sits on the upper tool ram 29. The link 32 carries a small foot 33 whose two angled off foot surfaces 34 extend below the gripper jaws 26 and the shank part 9', carried by the latter, of the button upper part 9. In order to receive the button upper part 9 the gripper jaws 26 are formed with holding notches 35.

Figure 2:
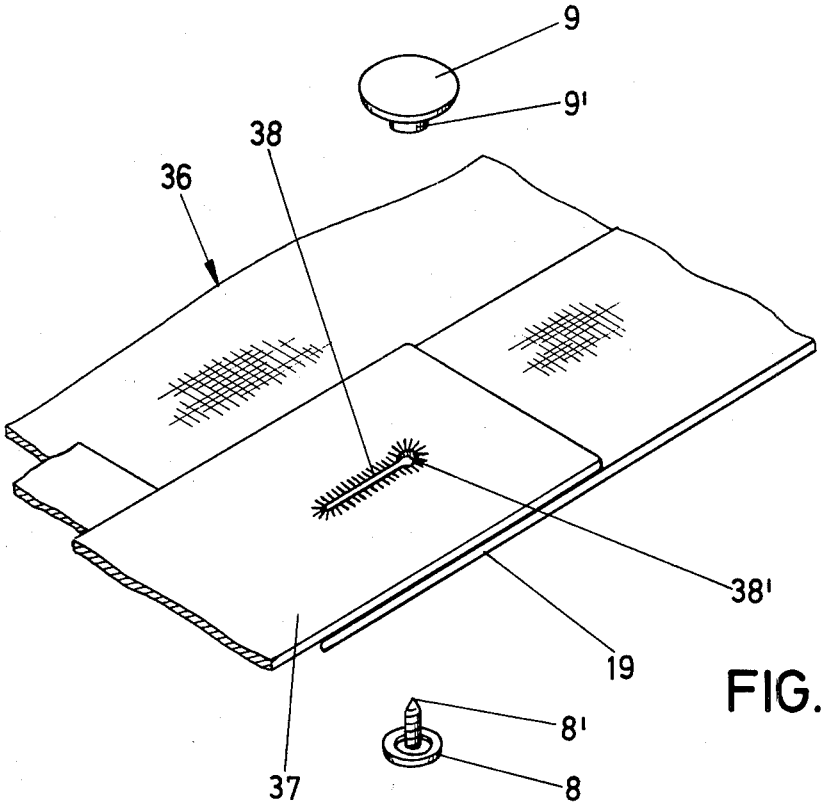
FIG. 2 shows in perspective the ends placed one above the other of a pair of slacks with the button parts arranged in correspondence but not yet applied.
Figure 3:
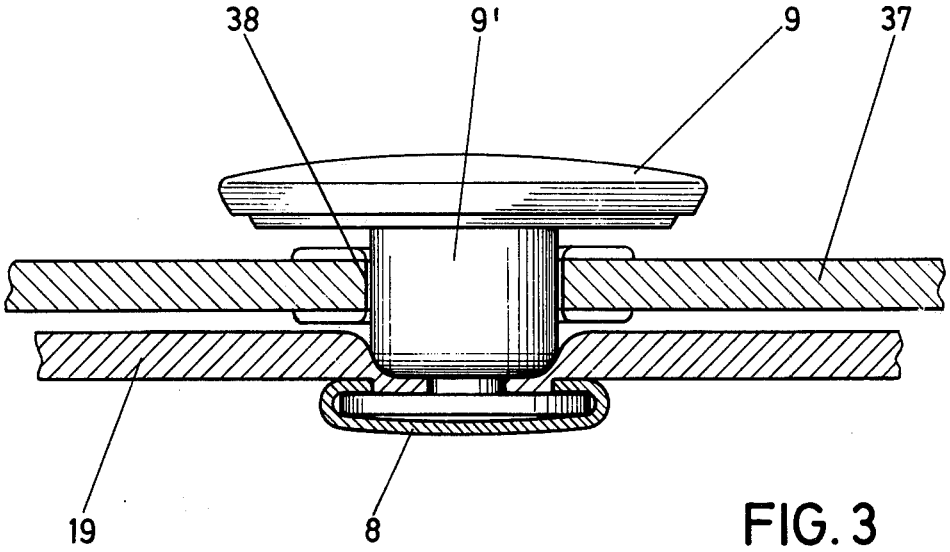
FIG. 3 shows on an enlarged scale a section through the superimposed layers of material with the button attached.
Figure 4:
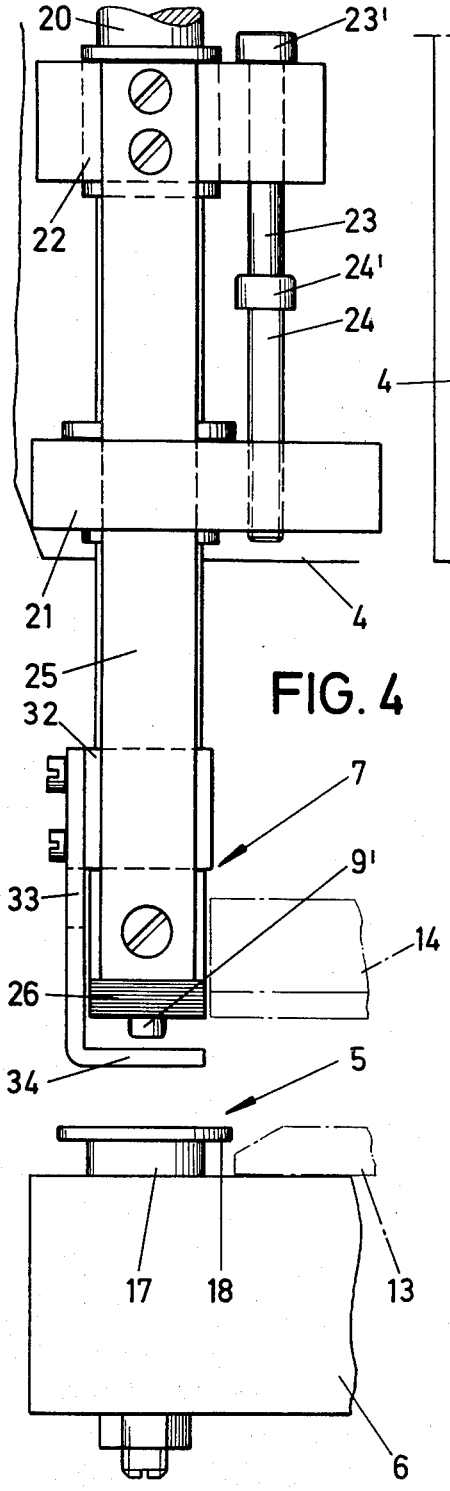
FIG. 4 is a view of the machine in the region of the upper tool and lower tool, with the upper tool in its raised position.
Figure 7:
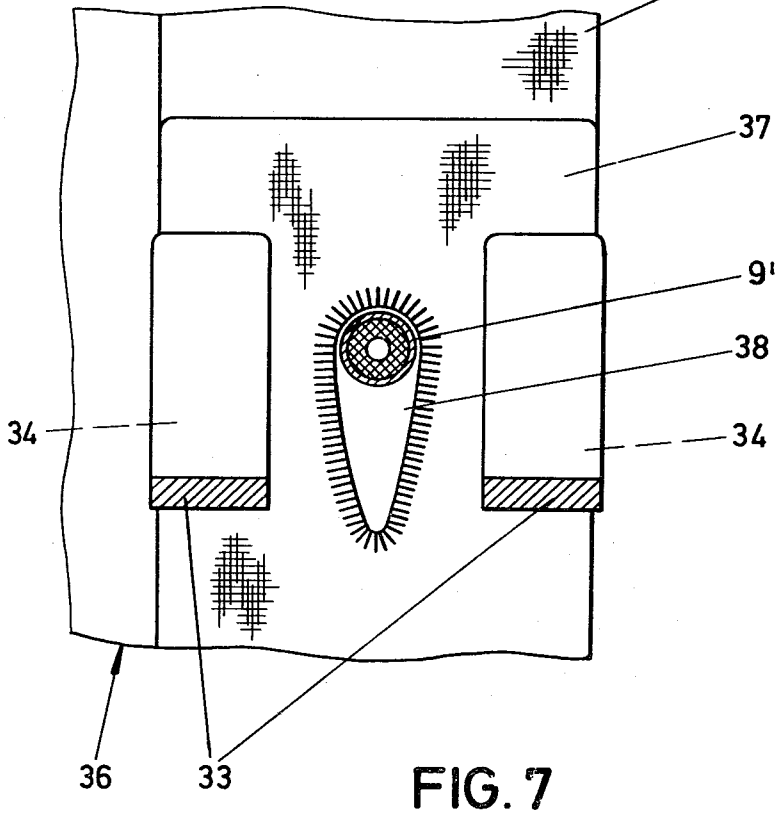
FIG. 7 is a cross section along the line VII—VII of FIG. 6.
Figure 6:
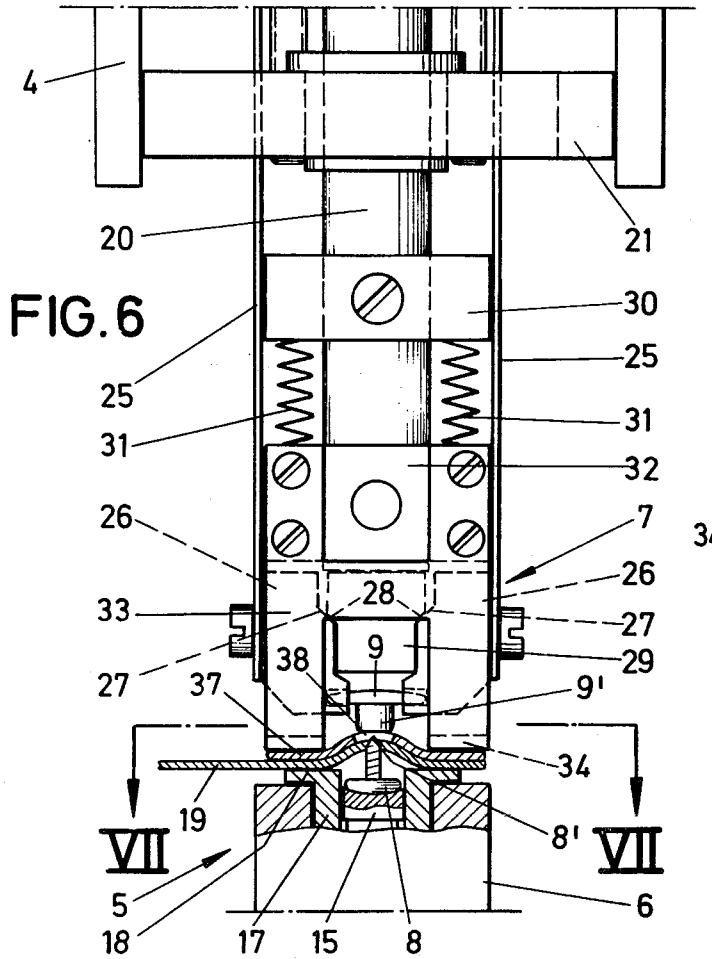
FIG. 6 is a showing similar to FIG. 5 in which the upper tool has been moved a given amount in downward direction and the device associated with it has brought about a widening of the buttonhole by arching.

If, as shown in particular in FIG. 2, the overlapping ends of the waistband of pants 36 are to be provided with a button, then one end of the waistband forms the lower layer of material 19 which is to be placed on the lower tool 5 and the other end of the waistband forms the upper layer of material 37. The upper waistband end or layer of material 37 bears the buttonhole 38 which is duly positioned with respect to the waistband end 19 and at its end has a thickened buttonhole end 38'. The pants 36 or the waistband ends thereof are now placed on the lower tool in such a manner that the thickened buttonhole end 38' is aligned with the direction of the button shank 9'. The actuating stroke of the ram 20 is now started by means of the pedal 3. Upon the downward displacement of the ram, the inclined flanks 28 of the upper tool ram 29, via the inclined surfaces 27 of the gripper jaws 26, entrain the latter and thus the slide 22 in the downward direction. At the same time the support bearing 30 which is connected to the push rod moves in the downward direction. This support bearing in its turn by means of the compression springs 31 pushes the small foot 33 in the downward direction, the foot surfaces 34 placing themselves onto the upper layer of material on both sides of the button rivet 8. In this way the supporting surface or rim 18 of the bushing 17 is pushed in the downward direction so that the point 8' of the button rivet 8 extends beyond the supporting surface 18. Simultaneously by this, the material is arched, which leads to a widening of the buttonhole 38; see FIGS. 6 and 7. This widening is of such an extent that the button shank 9' of the button upper part 9 can place itself, through the buttonhole 38, onto the lower layer of material 19, whereby the shaft of the button rivet 8 enters into the button shank 9' during the final phase of the downward travel of the upper tool. In this connection it may be mentioned that FIG. 6 concerns an intermediate position in the connecting of the button parts. Before the final assembly of the button parts, the downward movement of the slide 22 and thus of the gripper jaws 26 seated thereon is stopped so that the upper tool ram 29 upon its downward displacement spreads the gripper jaws apart via the oblique surfaces 27 whereupon the gripper jaws release the button upper-part 9 so that it can then be assembled to the button lower part 8 by the upper tool ram.

After the completion of the attachment of the button parts, the upper tool 7 moves back to its initial position, shown in FIG. 5. The lower tool is then also released of load and also returns to its starting position.

The lower tool could also be such that the supporting surface is fixed while the ram moves upward causing an arching of the layer of material.

In order to assure arching even in the case of thin materials, a slit sleeve or bushing which provides the actual support may be associated with the lower button part.

Figure 8:
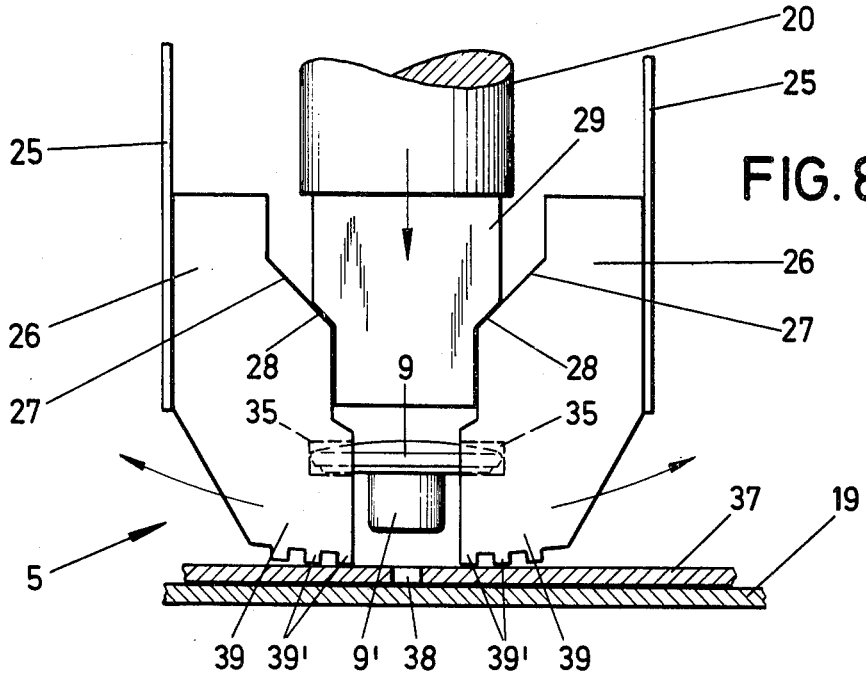
FIG. 8 shows the second embodiment, in which the gripper jaws are provided with projections which widen the buttonhole.

In the second embodiment, shown in FIG. 8, the gripper jaws 26 are continued as projections 39 which extend beyond the button shank 9'. These projections are in their turn provided with ribs 39' which, upon the downward displacement of the upper tool, place themselves on the upper layer of material 37. After the limiting of the downward displacement of the slide, a spreading apart of the gripper jaws 26 is then effected against spring action via the oblique surfaces 27 of the gripper jaws 26 and the oblique surfaces 28 of the upper tool ram 29, the projections 39, which are seated on the upper layer of material 37, widening the buttonhole 38. This therefore takes place by frictional engagement.

In this embodiment a positive widening of the buttonhole would be obtainable if the ribs were replaced by points which penetrate into the web of material.

Figure 9:
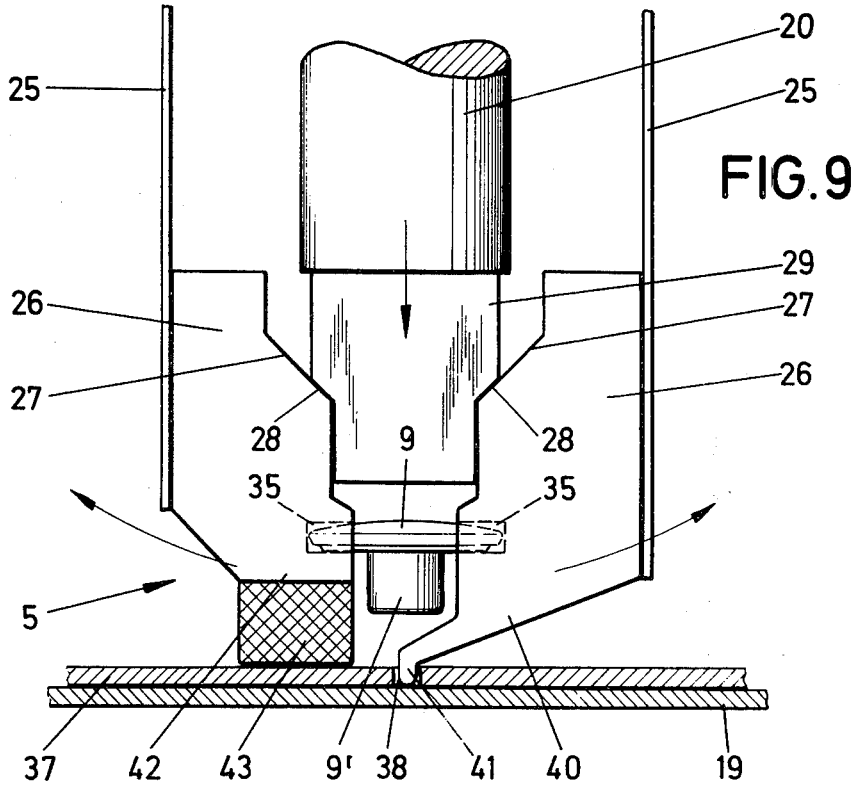
FIG. 9 shows the third embodiment, in which one projection has a finger which engages into the buttonhole and the other projection has a friction covering which places itself onto the upper layer of material.

In the case of the third embodiment, shown in FIG. 9, one projection 40 which extends beyond the button shank 9' is continued as a finger 41 which is bent off in a downward direction and extends into the buttonhole 38, while the other projection 42 is provided with a friction lining 43 which places itself on the upper layer of material. During the downward travel of the slide, and thus of the gripper jaws 26, the finger 41 engages into the buttonhole 38 while the other gripper jaw 36 places itself via the friction lining 43 onto the upper layer of material 37. After the stopping of the downward movement, the gripper jaws 26 spread apart in the direction indicated by the arrows, resulting in the opening of the buttonhole 38 so that thereupon the button shank 9' can pass through unimpeded.

Further embodiments are possible. Fingers which are displaceable by pin-inclined slot control can be provided on the gripper jaws, the fingers extending into the buttonhole upon the downward travel of the upper tool and then upon the further downward movement causing a spreading apart of the buttonhole.

Furthermore, a widening of the buttonhole could be effected by structural parts which are independent of the gripper jaws. For example, the finger guard could be employed for this purpose.

I claim:

1. In a machine for the attachment of buttons provided with shanks, respectively, to articles and having a lower tool which supports a button lower part and an upper tool which holds a button upper part in alignment with the button lower part, said upper tool being movable relative to the lower tool towards the lower part, the improvement comprising means disposed in front of said upper tool for widening a buttonhole in a first layer of material to approximately a width of said shank to be seated through the widened buttonhole onto an underlying layer of material to enable said button upper part and said button lower part to be engaged and secured to said underlying layer in alignment with said buttonhole.

2. The machine according to claim 1, comprising a supporting surface displaceably guidably mounted on said lower tool, the button lower part comprises a button rivet having a point, said widening means constitutes a small foot moveable back, against spring biasing, on said upper tool and has two foot surfaces spaced apart from each other on both sides of said button rivet operatively engageable on said supporting surface, said supporting surface is guidable by said lower tool and is displaceable to below said point of said button rivet by said small foot.

3. The machine according to claim 1, wherein said button upper part has said shank, said upper tool includes means comprising two spring-biased gripper jaws for releasably gripping said button upper part, said gripper jaws have projections which protrude to beyond said shank and are moveable back against spring biasing, said projections constituting means for placing themselves on the first layer provided with said buttonhole and for spreading apart said buttonhole in an applied position thereof.

4. The machine according to claim 3, wherein said upper tool includes an upper tool ram formed with oblique surfaces constituting means for effecting said spreading in cooperation with said gripper jaws and said projections.

5. The machine according to claim 3, wherein at least one of said projections has a finger which engages into said buttonhole.

6. The machine according to claim 3, further comprising a friction lining disposed on at least one of said projections.

7. The machine according to claim 1, comprising a displaceable supporting surface guidably and resiliently mounted on said lower tool, the button lower part comprising a button rivet having a point, said upper tool includes a foot member, said foot member being a constituent of said widening means and being movable against said supporting surface, to hold said first layer and said underlying layer between said foot member and said support surface, and to displace said supporting surface to a level below the level of the button rivet point such that said button rivet point is urged against said underlying layer to cause said first layer to bend at the area of said buttonhole and thereby widen said buttonhole.

8. The machine according to claim 7, wherein said foot member is resiliently mounted for relative movement with respect to said button upper part.

9. The machine according to claim 8, wherein said foot member comprises two foot surfaces spaced from each other at opposite sides of said button rivet.

10. The machine according to claim 1, wherein said button upper part has said shank, said upper tool includes two spring-biased gripper jaws for releasably gripping said button upper part, said gripper jaws having projections which protrude beyond said shank and are moveable against said supporting surface to hold said first layer and said underlying layer in a held condition, wherein said projections bear against said first layer at opposite sides of said buttonhole, and means on said upper tool for spreading said gripper jaws when said said first layer and said underlying layer are in said held condition to spread apart and thereby widen said buttonhole.

11. The machine according to claim 10, wherein said upper tool includes an upper tool ram and said means for spreading said gripper jaws and projections include oblique surfaces formed on said upper tool ram.

12. The machine according to claim 10, wherein at least one of said projections has a finger which engages into said buttonhole.

13. The machine according to claim 10, further comprising a friction lining disposed on at least one of said projections.

* * * * *